US010231522B2

(12) United States Patent
Shyr

(10) Patent No.: US 10,231,522 B2
(45) Date of Patent: Mar. 19, 2019

(54) LUGGAGE FOLDING SHELF

(71) Applicant: Godfrey Ching Shan Shyr, Ontario, CA (US)

(72) Inventor: Godfrey Ching Shan Shyr, Ontario, CA (US)

( * ) Notice: Subject to any disclaimer, the term of this patent is extended or adjusted under 35 U.S.C. 154(b) by 219 days.

(21) Appl. No.: 15/383,979

(22) Filed: Dec. 19, 2016

(65) Prior Publication Data

US 2018/0168306 A1 Jun. 21, 2018

(51) Int. Cl.

| | |
|---|---|
| ***A45C 13/00*** | (2006.01) |
| ***A45C 13/02*** | (2006.01) |
| ***A45C 5/03*** | (2006.01) |
| ***A45C 5/14*** | (2006.01) |
| ***A45C 13/10*** | (2006.01) |

(52) U.S. Cl.

CPC ..... *A45C 13/02* (2013.01); *A45C 5/03* (2013.01); *A45C 5/14* (2013.01); *A45C 13/1092* (2013.01)

(58) Field of Classification Search

CPC ... A45F 3/04; A45F 5/12; A45C 13/02; Y10T 29/49826

See application file for complete search history.

(56) References Cited

U.S. PATENT DOCUMENTS

| | | | | |
|---|---|---|---|---|
| 5,042,664 | A * | 8/1991 | Shyr | A45C 3/00 190/109 |
| 5,090,526 | A * | 2/1992 | Jacober | A45C 7/0077 190/107 |
| 7,779,976 | B2 * | 8/2010 | Mangano | A45C 13/02 190/110 |
| 9,375,061 | B2 * | 6/2016 | Mosee | A45C 1/02 |
| 2013/0043293 | A1 * | 2/2013 | Connell | A45F 3/04 224/652 |

FOREIGN PATENT DOCUMENTS

JP 2009022372 A * 2/2009

* cited by examiner

*Primary Examiner* — Tri M Mai
(74) *Attorney, Agent, or Firm* — Clement Cheng

(57) ABSTRACT

A luggage can be a locker bag, or a bag with a reconfigurable folding shelf and having a luggage frame having an opening covered by a front cover. The luggage frame has a pair of sidewalls, a top wall, a bottom wall and a rear wall. The pair of sidewalls includes a left wall and a right wall and a shelf panel. The shelf panel has a pivotal connection to either the left wall or the right wall. The shelf panel has a shelf panel extension extending away from the pivotal connection. A first buckle apparatus engages to a first buckle retainer apparatus on either the left wall or the right wall that the shelf panel is pivotally connected to when the shelf panel is in a stowed configuration.

10 Claims, 5 Drawing Sheets

LUGGAGE FOLDING SHELF

FIELD OF THE INVENTION

The present invention is in the field of luggage.

DISCUSSION RELATED ART

The prior art shows luggage with a folding shelf. For example, in U.S. Pat. No. 7,779,776 to inventor Mangano issued Aug. 24, 2010 entitled Versatile And Reconfigurable Luggage, the disclosure of which is incorporated herein by reference. Mangano teaches luggage shelving that folds up from a back surface of the luggage frame. Unfortunately, the Mangano configuration is difficult to implement, not lightweight and not very strong.

SUMMARY OF THE INVENTION

It is an object of this invention to provide folding shelves for a luggage that are both lightweight and strong, while easy to use.

A luggage can be a locker bag, or a bag with a reconfigurable folding shelf and having a luggage frame having an opening covered by a front cover. The luggage frame has a pair of sidewalls, a top wall, a bottom wall and a rear wall. The pair of sidewalls includes a left wall and a right wall and a shelf panel. The shelf panel has a pivotal connection to either the left wall or the right wall. The shelf panel has a shelf panel extension extending away from the pivotal connection. A first buckle apparatus engages to a first buckle retainer apparatus on either the left wall or the right wall that the shelf panel is pivotally connected to when the shelf panel is in a stowed configuration. The shelf panel is parallel to either the left wall or the right wall that the shelf is pivotally connected to an opposing buckle retainer apparatus on the left wall or the right wall that the shelf panel is not pivotally connected to. The opposing buckle retainer apparatus engages to the first buckle apparatus when the shelf panel is in a deployed shelf configuration.

The luggage preferably also includes a second folding shelf panel. The second folding shelf panel is attached to an opposite wall of the first folding shelf panel. The second folding shelf panel has a stowed position parallel to the sidewalls and a deployed position perpendicular to the sidewalls. The second folding shelf panel has a second pivotal connection to one of the sidewalls. The second pivotal connection is either higher or lower than the first pivotal connection. The second folding shelf is retained in a stowed position by a second buckle retainer apparatus that is on a wall opposite the first buckle retainer apparatus.

The first shelf is preferably configured to fold open so that the first buckle apparatus of the first shelf disengages from the first buckle retainer apparatus and engages to the opposing buckle retainer apparatus. The second shelf is configured to fold open so that the second buckle apparatus of the second shelf disengages from the second buckle retainer apparatus and engages to the second opposing buckle retainer apparatus.

The first buckle apparatus includes a pair of buckles, namely a front first buckle and a rear first buckle. The second buckle apparatus includes a pair of buckles, namely a front second buckle and a rear second buckle. The opposing buckle retainer apparatus includes a front opposing buckle retainer and a rear opposing buckle retainer. The second opposing buckle retainer apparatus includes a second front opposing buckle retainer and a second rear opposing buckle retainer.

The front first buckle engages to the front buckle retainer and the rear first buckle engages to the rear buckle retainer when the shelf panel is in the stowed configuration. The front first buckle engages to the front opposing buckle retainer and the rear first buckle engages to the rear opposing buckle retainer when the first shelf is deployed. The luggage preferably also has a vertical divider panel in pivotal connection with the shelf panel. The vertical divider panel extends from an underside of the shelf panel when deployed. The vertical divider panel folds parallel to the shelf panel when stowed. This system can be repeated for a large luggage to make multiple compartments in a variety of different configurations.

Figure 1:
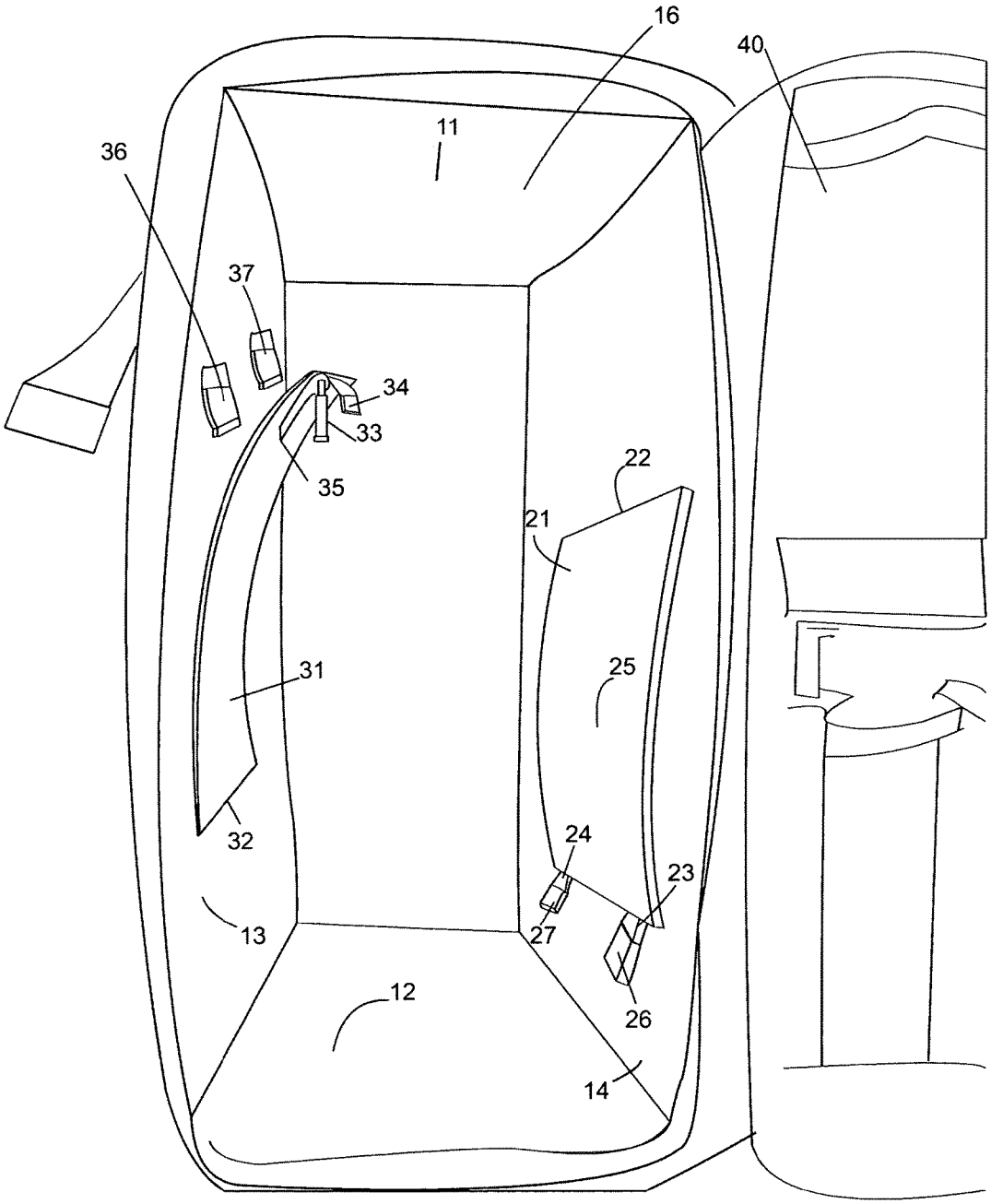
FIG. 1 is a front view of the luggage shelves in folded position.
Figure 2:
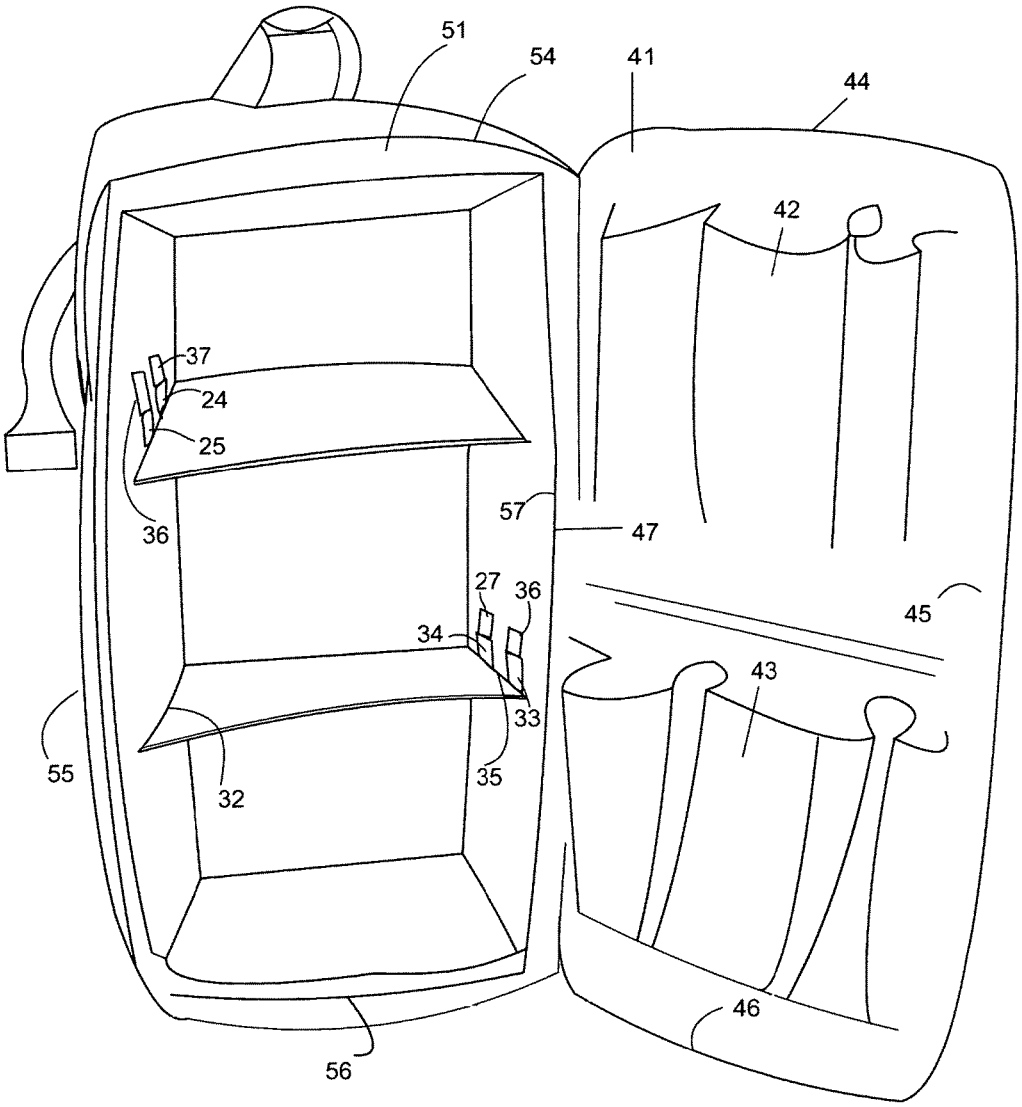
FIG. 2 is a front view of the luggage shelves in deployed position.

The following call list of elements can be a useful guide in referencing the elements of the drawings.

11 Top Wall
12 Bottom Wall
13 Left Wall
14 Right Wall
15 Back Wall
16 Luggage Frame
21 Right Panel
22 Right Panel Hinge
23 Right Panel Front Buckle
24 Right Panel Rear Buckle
25 Right Panel Extension
26 Right Panel Front Buckle Retainer
27 Right Panel Rear Buckle Retainer
31 Left Panel
32 Left Panel Hinge
33 Left Panel Front Buckle
34 Left Panel Rear Buckle
35 Left Panel Extension
36 Left Panel Front Buckle Retainer
37 Left Panel Rear Buckle Retainer
40 Front Cover
41 Front Cover Panel
42 Cover First Compartment
43 Cover Second Compartment
44 Front Cover Top Edge
45 Front Cover Outer Edge
46 Front Cover Bottom Edge
47 Front Cover Inside Edge
51 Luggage Opening
54 Opening Top Edge
55 Opening Outer Edge
56 Opening Bottom Edge
57 Opening Inside Edge
60 Vertical Divider Panel

61 Vertical Divider Panel Connector
62 Vertical Divider Panel Receiver
63 Vertical Divider Panel Hinge
64 Median Line
65 Handle
71 Male Buckle Member
72 Female Buckle Member
73 Male Buckle Member Strap
74 Female Buckle Member Strap
75 Female Buckle Opening
76 Male Buckle Engaging Member
77 Male Buckle Engaging Edge

DETAILED DESCRIPTION OF THE PREFERRED EMBODIMENT

A luggage is a container for holding articles during transportation and can be a locker bag or travel bag for example. The present invention is a luggage having a frame that can have wheels attached to the luggage frame 16. The luggage frame 16 generally includes a top wall 11, a bottom wall 12, a left wall 13, a right wall 14 in a back wall 15. The walls of the frame receive a front cover 40. The front cover 40 is mounted to a front cover panel 41. The walls are generally oriented in a rectangular prism configuration to provide a luggage opening 51 for storing articles. The walls are preferably rectangular and rigid members.

A right panel 21 and a left panel 31 are mounted to an inside surface of the luggage frame 16. The right panel 21 is mounted to a right wall 14. The left panel 31 is mounted to a left wall 13. The back wall 15 is nonornamented and not connected to the right panel 21 or the left panel 31. The right panel on the left panel can be made of fabric holding a flexible plastic panel inside a fabric laminate structure. The flexible plastic panel can be held in a compartment such as within a pocket of a fabric laminate structure, or the flexible plastic panel can be thermally laminated to the fabric laminate. The flexible fabric panel can be a high density polypropylene or high density polyethylene plastic panel.

Figure 3:
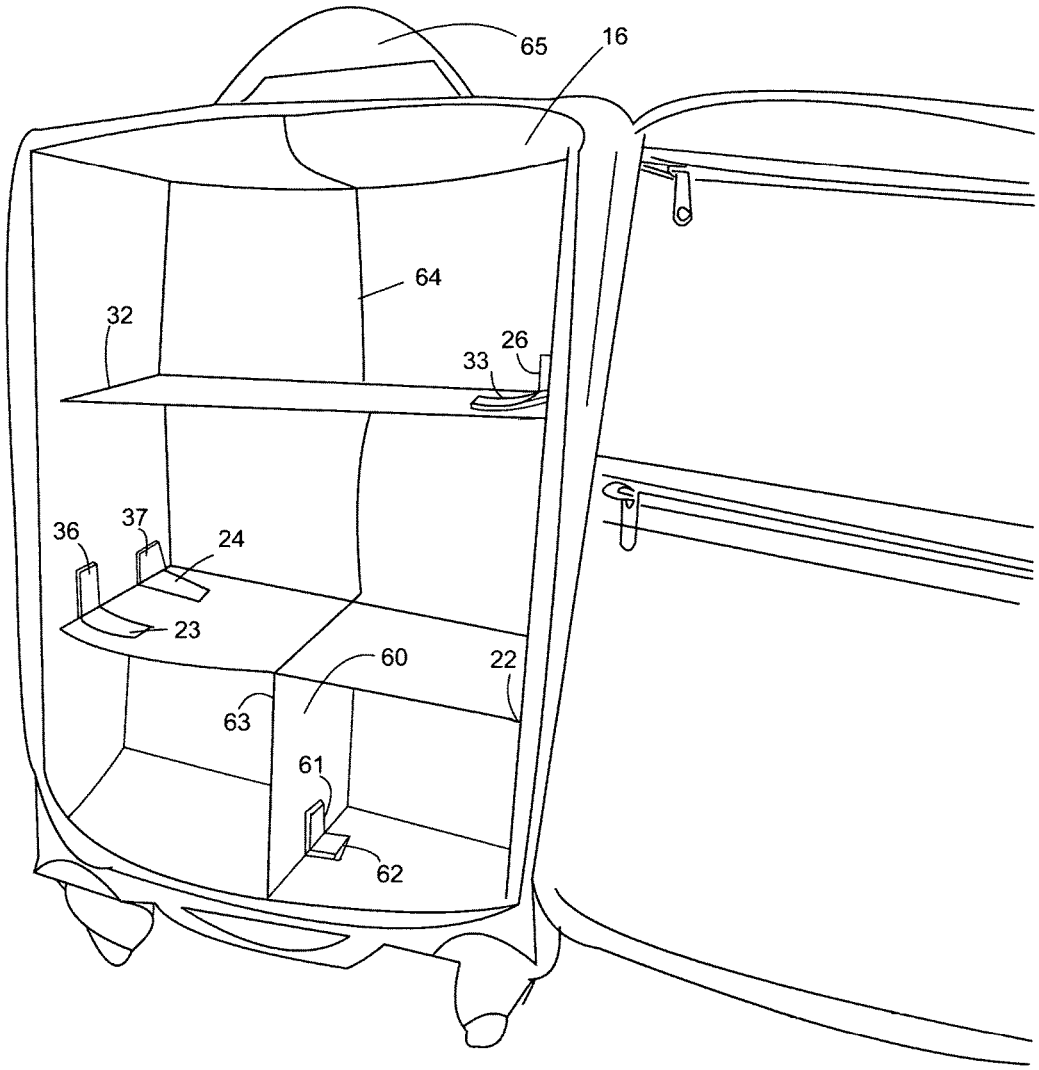
FIG. 3 is a front view of the luggage shelves in deployed position including the panel vertical flap.
Figure 4:
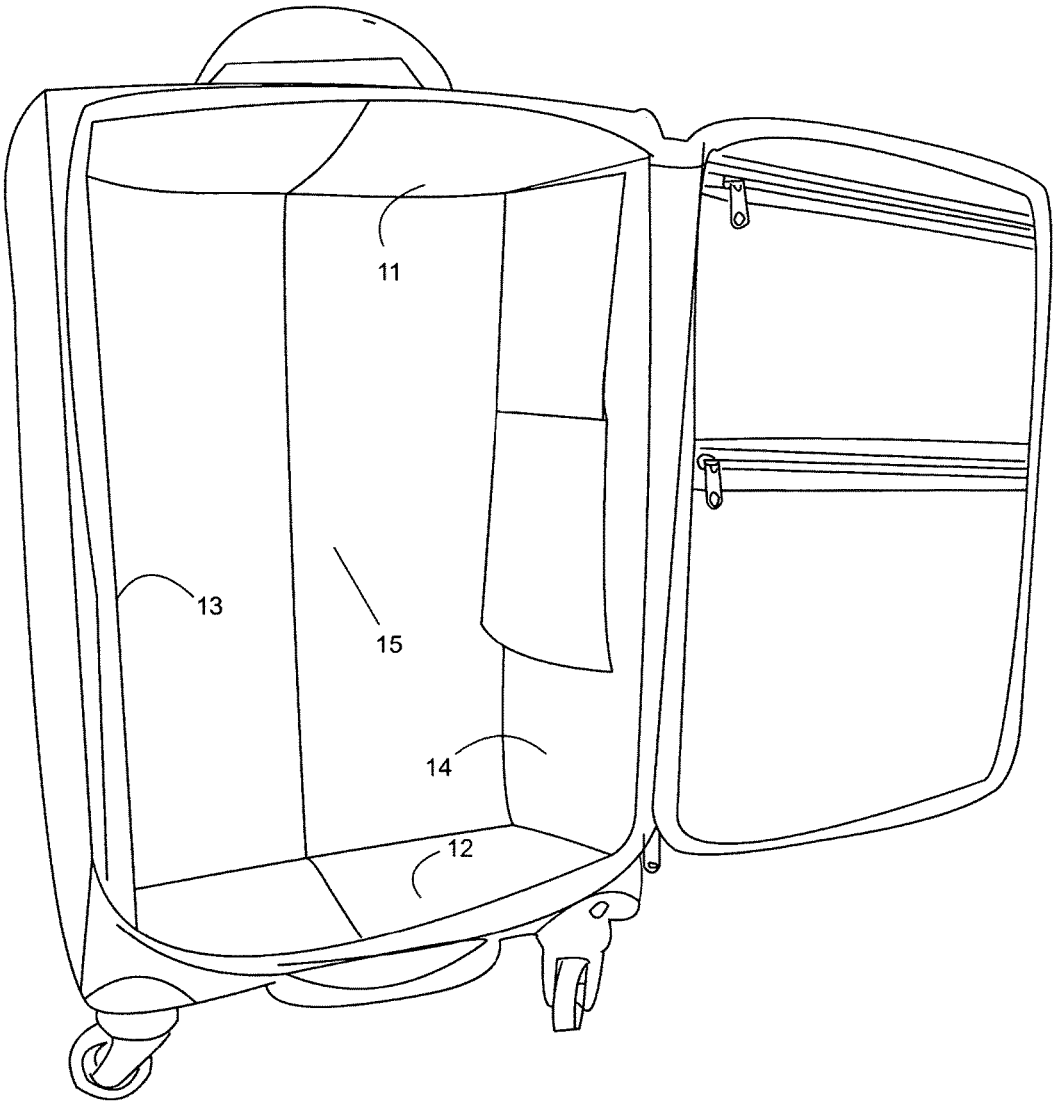
FIG. 4 is a front view of the luggage shelves in folded position with the vertical divider panel folded.

The right panel 21 can be hinged at a right panel hinge 22. The left panel 31 can be hinged at a left panel hinge 32. The right panel hinge 22 can be at a height higher than the left panel hinge 32 as seen in FIG. 1 where the right panel folds upward to a horizontal position from a vertical position. As seen in FIG. 1, the right panel 21 can have a right panel extension that point downwardly when the right panel is in a stowed configuration. Alternatively, the right panel hinge 22 can be at a height lower than the left panel hinge 32 as seen in FIG. 3 where the right panel folds downward to a horizontal position from a vertical position. As seen in FIG. 3, the right panel 21 can have a right panel extension that points upwardly when the right panel is in a stowed configuration. Similarly, the left panel as seen in FIG. 1 can have a left panel extension that points upwardly when the left panel is in a stowed configuration. Alternatively, the left panel as seen in FIG. 3 can have a left panel extension that points downwardly when the left panel is in a stowed configuration.

The right panel and the left panel are preferably storable in a stowed configuration when the right panel and the left panel are parallel to the right wall 14 and the left wall 13 of the luggage frame. The left panel can be maintained in a parallel configuration when the left panel front buckle 33 is connected to the left panel front buckle retainer 36 and the left panel rear buckle 34 is connected to the left panel rear buckle retainer 37. The left panel front buckle 33 is in front of the left panel rear buckle 34. The left panel 31 is generally rectangular and has a left panel hinge 32 which can be stitched to a fabric left wall 13.

Similarly, the right panel can be maintained in a parallel configuration when the right panel front buckle retainer 26 is engaged to the right panel front buckle 23, and the right panel rear buckle 24 is engaged to the right panel rear buckle retainer 27. The right panel rear buckle 27 is behind the right panel front buckle retainer 26, and the right panel front buckle 23 is in front of the right panel rear buckle 24. Similarly, the left panel rear buckle 34 is behind the left panel front buckle 33, and the left panel rear buckle retainer 37 is behind the left panel front buckle retainer 36. The rear back wall 15 of the frame is an area that is furthest away from the front cover 40. The rear back wall 15 is preferably parallel to the front cover 40 when the front cover 40 is closed.

When a user desires to transform the panels into shelves, the user detaches the panels from the panel retainers and rotates the panels into a horizontal position deployed from a vertical stowed position. The left panel 31 has a panel extension 35 that connects to the pair of right panel buckle retainers. Therefore, the left panel extension 35 has a left panel front buckle 33 that connects to the right panel front buckle retainer, and the left panel extension has a left panel rear buckle 34 that connects to the right panel rear buckle retainer 27, when the left panel is folded and engaged to a deployed position. Similarly, the right panel 21 has a right panel extension 25 that has a right panel front buckle 23 connecting to a left panel front buckle retainer 36, and the right panel has a right panel extension 25 that has a right panel rear buckle 24 that connects to a left panel rear buckle retainer 37 when the right panel 21 is folded and engaged to a deployed position. Therefore, the buckles that retain their panels when in a vertical folded position also retain their opposite panels in a horizontal deployed position. The buckles can be color-coded for ease in transformation between the shelf mode and the stowed shelf mode.

The front cover 40 preferably has a front cover first compartment 42 for storing articles. The front cover first compartment 42 can be above a front cover second compartment 43. The first compartment and the second compartment can store articles on the front cover 40. The front cover has a front cover top edge 44, a front cover outer edge 45 and a front cover bottom edge 46. The front cover also has a front cover inside edge 47 that is pivotally connected to and hinges with the opening inside edge 57 so that the front cover inside edge 47 is parallel to the opening inside edge 57. Similarly, the opening outer edge 55 is parallel to the front cover outer edge 45. Analogously, the front cover top edge 44 is parallel to the opening top edge 54 when the front cover top edge 44 is secured to the opening top edge 54. When the front cover 40 is closed, the opening top edge 54 is zippered to the front cover top edge 44, the opening outer edge 55 is zippered to the front cover outer edge 45, and the opening bottom edge 56 is zippered to the front cover bottom edge 46. The front cover 40 has a closed and open configuration. The figures show the front cover 40 in open configuration.

The frame has a handle 65 opposite the wheels. The wheels are attached at the bottom end of the handle 65. A second handle can be mounted near the wheels for double handle grabbing economics. The handle 65 is mounted along the median line 64 that bisects the luggage frame between a right and left half of the luggage frame. The median line 64 can have a zipper along its length so that a liner can be opened along the median line 64. The liner is a fabric cover for preserving articles within the rigid luggage frame.

A vertical divider panel 60 can extend downwardly from the left or right panel when the left or right panel is deployed. The lower panel which can be either the left or right panel in a horizontal configuration, can have a vertical divider panel 60 extending from the lower panel. The vertical divider panel 60 is generally square in shape and flexibly resilient, with preferably a plastic supporting sheet that is preferably at least 60 mil in thickness. The plastic supporting sheet is preferably thick enough to form a board to support articles. The plastic supporting sheet of the vertical divider panel 60 can be encapsulated or laminated to a fabric of the vertical divider panel 60. The vertical divider panel 60 extends downwardly from the lower panel so that the vertical divider panel connector 61 can connect to a vertical divider panel receiver 62. The vertical divider panel 60 has a vertical divider panel hinge 63 to provide a hinged motion between the vertical divider panel 60 and the lower panel. The vertical divider panel hinge 63 is preferably fabric hinge lacking metal or plastic hardware. As seen in FIG. 3, the lower panel is the right panel because the right panel hinge 22 is on the right side. Similarly, the right panel hinge 22 is preferably a fabric hinge that lacks metal or plastic hardware. The upper shelf panel is preferably made of a plastic board covered by a lining and then the lining is sewn directly to the left or right wall and fastened with a grommet or other comparable connector. A fabric hinge can be made by providing a flexible fabric portion between the sidewall and the plastic board. The flexible fabric portion forms a hinged connection.

The vertical divider panel 60 is stowed in a vertical orientation and hinged at the vertical divider panel hinge 63 to the lower panel. The vertical divider panel 60 preferably bisects the lower compartment into a left lower compartment and a right lower compartment. The lower compartment is below the middle compartment and the middle compartment is below the upper compartment. The upper compartment is formed between the upper panel and the luggage frame.

Figure 5:
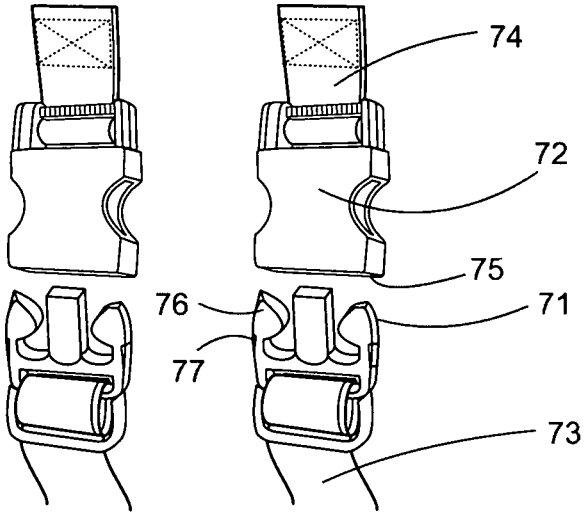
FIG. 5 is a buckle detail drawing showing a pair of buckles with side engagement edges.
Figure 6:
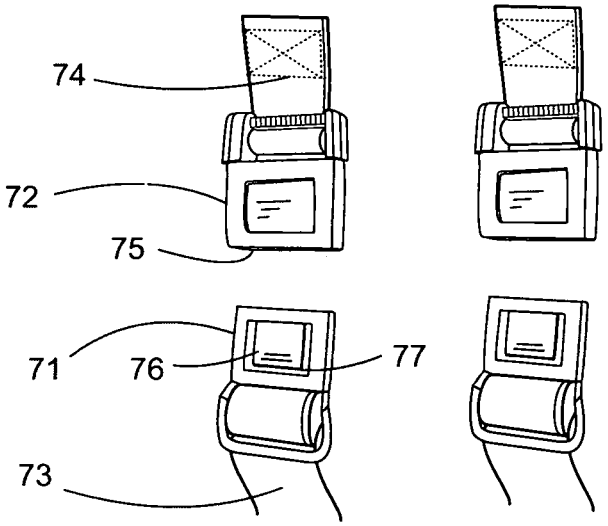
FIG. 6 is a buckle detail drawing showing a pair of buckles with front engagement edges.

The apparatus preferably has a two pairs of buckles for allowing rearrangement of the shelf panels. For example, the right panel front buckle 23, the right panel rear buckle 24, the left panel front buckle 33, the left panel rear buckle 34, the left panel front buckle retainer 36, the left panel rear buckle retainer 37, the right panel from buckle retainer 26, and the right panel rear buckle retainer 27 can all be constructed according to a male and female buckle system. The male and female buckle system as seen in FIGS. 5 and 6 includes a male buckle member 71 that inserts into a female buckle member 72. The male buckle member 71 has a male buckle member strap 73. The male buckle member strap 73 can be connected to either the wall or shelf. Similarly, the female buckle strap 74 is connected to the female buckle member 72 and the female buckle shelf 74 can be connected to either the wall or shelf. The female buckle has a female buckle opening 75 for receiving a male buckle engaging member 76. The male buckle engaging member 76 has a spring bias for retaining to the female buckle. The male buckle engaging member 76 also includes a male buckle engaging edge 77 that lodges to the female buckle.

The buckle straps are fabric and are stitched to the sidewalls and the shelf panel extensions. Accordingly, the buckles are made of a pair of members, namely a male member and a female member. The buckle retainers can be either the male or female members and the buckles attached to the shelf extension portions at the tip ends of the shelves can be an opposite member.

The invention claimed is:

1. A luggage having a reconfigurable folding shelf comprising:

a. a luggage frame having an opening covered by a front cover, wherein the luggage frame has a pair of sidewalls, a top wall, a bottom wall and a rear wall, wherein the pair of sidewalls includes a left wall and a right wall;

b. a shelf panel, wherein the shelf panel has a pivotal connection to either the left wall or the right wall, wherein the shelf panel has a shelf panel extension extending away from the pivotal connection, wherein a first buckle apparatus engages to a first buckle retainer apparatus on either the left wall or the right wall that the shelf panel is pivotally connected to when the shelf panel is in a stowed configuration, wherein the shelf panel is parallel to either the left wall or the right wall that the shelf is pivotally connected to; and c. an opposing buckle retainer apparatus on the left wall or the right wall that the shelf panel is not pivotally connected to, wherein the opposing buckle retainer apparatus engages to the first buckle apparatus when the shelf panel is in a deployed shelf configuration, further including a vertical divider panel in pivotal connection with the shelf panel, wherein the vertical divider panel extends from an underside of the shelf panel when deployed, and wherein the vertical divider panel folds parallel to the shelf panel when stowed.

2. The luggage of claim 1, further including: a second folding shelf panel, wherein the second folding shelf panel is attached to an opposite wall of the first folding shelf panel, wherein the second folding shelf panel has a stowed position parallel to the sidewalls and a deployed position perpendicular to the sidewalls, wherein the second folding shelf panel has a second pivotal connection to one of the sidewalls, wherein the second pivotal connection is either higher or lower than the first pivotal connection, wherein the second folding shelf is retained in a stowed position by a second buckle retainer apparatus that is on a wall opposite the first buckle retainer apparatus.

3. The luggage of claim 2, wherein the first shelf is configured to fold open so that the first buckle apparatus of the first shelf disengages from the first buckle retainer apparatus and engages to the opposing buckle retainer apparatus, wherein the second shelf is configured to fold open so that the second buckle apparatus of the second shelf disengages from the second buckle retainer apparatus and engages to the second opposing buckle retainer apparatus.

4. The luggage of claim 3, wherein the first buckle apparatus includes a pair of buckles, namely a front first buckle and a rear first buckle, wherein the second buckle apparatus includes a pair of buckles, namely a front second buckle and a rear second buckle wherein the opposing buckle retainer apparatus includes a front opposing buckle retainer and a rear opposing buckle retainer, wherein the second opposing buckle retainer apparatus includes a second front opposing buckle retainer and a second rear opposing buckle retainer.

5. The luggage of claim 4, wherein the front first buckle engages to the front buckle retainer and the rear first buckle engages to the rear buckle retainer when the shelf panel is in the stowed configuration, wherein the front first buckle engages to the front opposing buckle retainer and the rear first buckle engages to the rear opposing buckle retainer when the first shelf is deployed.

6. The luggage of claim 1, further including a vertical divider panel in pivotal connection with the shelf panel, wherein the vertical divider panel extends from an underside of the shelf panel when deployed, and wherein the vertical divider panel folds parallel to the shelf panel when stowed.

7. The luggage of claim 6, further including: a second folding shelf panel, wherein the second folding shelf panel is attached to an opposite wall of the first folding shelf panel, wherein the second folding shelf panel has a stowed position parallel to the sidewalls and a deployed position perpendicular to the sidewalls, wherein the second folding shelf panel has a second pivotal connection to one of the sidewalls, wherein the second pivotal connection is either higher or lower than the first pivotal connection, wherein the second folding shelf is retained in a stowed position by a second buckle retainer apparatus that is on a wall opposite the first buckle retainer apparatus.

8. The luggage of claim 7, wherein the first shelf is configured to fold open so that the first buckle apparatus of the first shelf disengages from the first buckle retainer apparatus and engages to the opposing buckle retainer apparatus, wherein the second shelf is configured to fold open so that the second buckle apparatus of the second shelf disengages from the second buckle retainer apparatus and engages to the second opposing buckle retainer apparatus.

9. The luggage of claim 8, wherein the first buckle apparatus includes a pair of buckles, namely a front first buckle and a rear first buckle, wherein the second buckle apparatus includes a pair of buckles, namely a front second buckle and a rear second buckle wherein the opposing buckle retainer apparatus includes a front opposing buckle retainer and a rear opposing buckle retainer, wherein the second opposing buckle retainer apparatus includes a second front opposing buckle retainer and a second rear opposing buckle retainer.

10. The luggage of claim 9, wherein the front first buckle engages to the front buckle retainer and the rear first buckle engages to the rear buckle retainer when the shelf panel is in the stowed configuration, wherein the front first buckle engages to the front opposing buckle retainer and the rear first buckle engages to the rear opposing buckle retainer when the first shelf is deployed.

* * * * *